US006895913B2

(12) United States Patent
Dietz et al.

(10) Patent No.: US 6,895,913 B2
(45) Date of Patent: May 24, 2005

(54) INTERNAL-COMBUSTION ENGINE WITH A HYDRAULIC DEVICE FOR A ROTATION ANGLE ADJUSTMENT OF A CAMSHAFT RELATIVE TO A CRANKSHAFT

(75) Inventors: Joachim Dietz, Frensdorf (DE); Rainer Ottersbach, Aurachtal (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/903,363

(22) Filed: Jul. 30, 2004

(65) Prior Publication Data

US 2005/0034692 A1 Feb. 17, 2005

Related U.S. Application Data

(60) Provisional application No. 60/495,599, filed on Aug. 15, 2003.

(51) Int. Cl.[7] ..... F01L 1/34

(52) U.S. Cl. ..... 123/90.17; 123/90.15; 123/90.31

(58) Field of Search ..... 123/90.17, 90.15, 123/90.31

(56) References Cited

U.S. PATENT DOCUMENTS 6,390,044 B2 * 5/2002 Yoshizawa et al. ..... 123/90.17

6,505,585 B1 * 1/2003 Machida et al. ..... 123/90.17

* cited by examiner

*Primary Examiner*—Thomas Denion
*Assistant Examiner*—Zelalem Eshete
(74) *Attorney, Agent, or Firm*—Volpe and Koenig, P.C.

(57) ABSTRACT

The invention relates to an internal-combustion engine with a hydraulic device (1) for rotation angle adjustment of a camshaft (3) relative to a crankshaft thereof, which is arranged on the drive-side end (2) of the camshaft (3) supported in several radial bearings (4) in the cylinder head (5) of the internal-combustion engine. The device essentially includes a drive unit (6) drivingly connected with the crankshaft and also of a driven unit (7) rotationally fixed to the camshaft (3). The drive unit (6) is in force-transfer connection with the driven unit (7) through at least two pressure chambers (12, 13), which are formed within the device (1) and which can be charged with a pressurized medium, wherein the pressurized medium is fed from one of the radial bearings (4) of the camshaft (3) and supplied to the pressure chambers (12, 13) of the device via first and second radial bore holes (14, 15) and via first and second axial channels (16, 17) in the camshaft (3), and also via first and second axial channels (19, 20) and via first and second radial bore holes (21, 22) into the driven unit (7). At least the first axial channels (16) formed as coaxial bore holes in the camshaft (3) and the first axial channels (19) in the driven unit (7) of the device (1) are connected to each other via a ring-shaped pressurized medium adapter (23) arranged between the end (18) of the camshaft (3) and the driven unit (7) of the device (1).

6 Claims, 4 Drawing Sheets

INTERNAL-COMBUSTION ENGINE WITH A HYDRAULIC DEVICE FOR A ROTATION ANGLE ADJUSTMENT OF A CAMSHAFT RELATIVE TO A CRANKSHAFT

FIELD OF THE INVENTION

The invention relates to an internal-combustion engine with a hydraulic device for rotation angle adjustment of a camshaft relative to a crankshaft, in which the hydraulic device for the rotation angle adjustment is arranged on the drive-side end of the camshaft supported by several radial bearings in the cylinder head of the internal-combustion engine and in principle is formed as a hydraulic actuating drive. The hydraulic device includes a drive unit drivingly connected with the crankshaft of the internal-combustion engine and a driven unit rotationally fixed to the camshaft of the internal-combustion engine. The driven unit is mounted by an axial central fastener on the camshaft and the drive unit is formed as a hollow cylinder, which surrounds the driven unit and which is sealed from a pressurized medium by two axial side walls. The drive unit is in force-transfer connection with the driven unit of the device through at least two pressure chambers which are formed within the device and which can be charged with a hydraulic pressurized medium alternately or simultaneously. The hydraulic pressurized medium is removed fed one of the radial bearings of the camshaft and guided via first and second radial bore holes and also via first and second axial channels in the camshaft first to the end of the camshaft. The first and second axial channels in the camshaft are in pressurized connection via first and second axial channels and also via first and second radial bore holes in the driven unit of the device with the pressure chambers (12, 13).

BACKGROUND

From DE 100 49 494 A1, a generic internal-combustion engine with a hydraulic device for rotation angle adjustment of a camshaft is known, for which the device is arranged at a drive-side end of the camshaft supported by several radial bearings in the cylinder head of the internal-combustion engine and is formed in principle as a hydraulic actuating drive. This device is essentially formed of a drive unit in drive connection with the crankshaft of the internal-combustion engine and a driven unit rotationally fixed to the camshaft of the internal-combustion engine, wherein the driven unit is formed as an impeller and is mounted by an axial central fastener on the camshaft, while the drive unit is formed by a hollow cylinder surrounding the driven unit. The drive unit is sealed tight against a pressurized medium by two axial side walls. The drive unit is then in force-transfer connection with the driven unit of the device through five hydraulic operating spaces, which are formed within the device and which are each divided by the impeller blades of the impeller into two pressure chambers that can be charged alternately or simultaneously with a hydraulic pressurized medium, wherein the hydraulic medium is fed from one of the radial bearings of the camshaft by the lubricating oil circuit of the internal-combustion engine. In this way, the pressurized hydraulic medium of the radial bearing is first led to the end of the camshaft via first and second radial bore holes, and also via first and second axial channels, which in turn are in pressurized connection with the pressure chambers via first and second axial channels and also via first and second radial bore holes in the driven unit of the device. The first axial channels in the camshaft and the first axial channels in the driven unit of the device are thus actually formed as axial bore holes that are arranged coaxially in both parts and that open into the other, while the second axial channels in the camshaft and the second axial channels in the driven unit of the device are formed by the screw hole led through the end of the camshaft and also through the driven unit in the axial direction for the central fastener for fastening the device to the camshaft.

However, one disadvantage for this known internal-combustion engine is that the device used for adjusting the rotation angle can only be used exclusively in such internal-combustion engines, for which the axial channels formed as coaxial bore holes in the camshaft for supplying the pressurized medium to the device have the exact same number and arrangement as the axial channels likewise formed as coaxial bore holes in the driven unit of the device. For each different application, for which the number and/or arrangement of the coaxial bore holes in the camshaft no longer agree with the coaxial bore holes in the driven unit, either the driven unit of the device must be adapted to the differently configured camshaft of the internal-combustion engine or a camshaft modified according to the driven unit of the device must be installed in the internal-combustion engine. For the case of adapting the device to the camshaft, however, this requires, e.g., for devices made from sintered metal, for each application a special sintered tool for producing the driven unit of the device. Also, adapting the camshaft of the internal-combustion engine to the drive unit of the device would require at least one modification of the casting mold for the camshaft, so that in both cases, due to the additional adaptation expense, a disadvantageous increase of the production costs for the internal-combustion engine must be taken into account.

SUMMARY

Therefore, the invention is based on the objective of designing an internal-combustion engine with a hydraulic device for rotation angle adjustment of a camshaft relative to a crankshaft thereof, wherein devices for adjusting the rotation angle, for which the first axial channels formed as coaxial bore holes in the driven unit deviate in number and/or arrangement from the first axial channels also formed as coaxial bore holes in the camshaft, can be attached with simple means to the camshaft of the engine without additional modification expense in the device for rotation angle or in the camshaft.

According to the invention, this objective is solved for an internal-combustion engine with a hydraulic device for rotation angle adjustment of a camshaft relative to a crankshaft in which at least the first axial channels formed as coaxial bore holes in the camshaft and first axial channels in the driven unit of the device are connected to each other by a ring-shaped pressurized medium adapter arranged between an end of the camshaft and the driven unit of the device), which is formed on its device-side end with through holes produced in the same number and arrangement as the first axial channels in the driven unit and has in its camshaft-side end at least one annular groove connecting the through holes to each other. This camshaft-side annular groove is formed such that in the assembled state of the pressurized medium adapter, all of the first axial channels emerging from the end of the camshaft for supplying the pressurized medium to the device are surrounded by this annular groove or open into this annular groove nearly independent of their number and arrangement, so that the pressurized medium led through the first axial channel in the camshaft is distributed over the annular groove uniformly to all through holes in the pressurized medium adapter and thus to the first axial channels in the driven unit of the device.

In one advantageous refinement of the internal-combustion engine formed according to the invention, the ring-shaped pressurized medium adapter has an outer diameter corresponding to a diameter of the drive-side end of the camshaft, while its inner diameter corresponds to the diameter of a centering pin formed on an end of the camshaft and projecting into a centering hole in the driven unit of the device. Through this centering pin, which can also be formed in an equivalent configuration also on the driven unit of the device and can project into a corresponding axial bore hole in the end of the camshaft, on one hand, the pressurized medium adapter is centered to the device and, on the other hand, the device is centered to the camshaft, which then tightens both through the axial central fastener to the end of the camshaft. With reference to the thickness of the ring-shaped pressurized medium adapter, it has been proven especially advantageous to form this in connection with the maximum thread depth of the threaded bore hole for the central fastener, such that unintended release of the pressurized medium adapter for the assembly of the device on the camshaft makes impossible the tightening of the device to the end of the camshaft, so that the pressurized medium adapter simultaneously has an integrated control function for the device assembly.

Another feature of the ring-shaped pressurized medium adapter of the internal-combustion engine formed according to the invention is that its annular groove in the camshaft-side end preferably has a rectangular cross-sectional profile, whose groove width is greater than the groove depth and also greater than a diameter of the through holes in the pressurized medium adapter, as well as greater than a diameter of the first axial channels formed as axial bore holes in the driven unit of the device. Through the greater groove width relative to these bore holes, which can be realized alternatively also with a triangular or trapezoidal cross-section profile of the annular groove, the advantage of the pressurized medium adapter mentioned in the introduction is guaranteed, such that all of the first axial channels emerging from the end of the camshaft open into the annular groove of the pressurized medium adapter nearly independent of their number and arrangement. However, because limits are set on the width of the annular groove in the pressurized medium adapter in so far that the other camshaft-side end of the pressurized medium adapter forms a friction surface against the camshaft and thus affects the slipping moment that can be adjusted by the central fastener of the device between the device and the camshaft, it is not possible in any case that all of the first axial channels in the camshaft open with their full diameter into the annular groove in the pressurized medium adapter. For a fault-free operation of the device, however, the amount of flow of pressurized hydraulic medium has also proven to be sufficient when the annular groove has a groove width, for which the first axial channels in the camshaft are overlapped slightly by the camshaft-side end of the pressurized medium adapter.

To guarantee an exact agreement of the through holes in the pressurized medium adapter to the first axial channels formed as axial bore holes in the driven unit of the device also after the assembly of the device on the camshaft, it is also proposed in a further configuration of the internal-combustion engine formed according to the invention that the pressurized medium adapter and the driven unit of the device have at least two other axial bore holes, in which two alignment pins or alignment sleeves can be inserted for exact position fixing of the pressurized medium adapter to the driven unit of the device. Through these alignment pins or alignment sleeves, in a simple way a positive-fit connection between the device and the pressurized medium adapter is created, with which a relative rotation of the pressurized medium adapter to the device is prevented when it is screwed onto the camshaft. Here, it is especially advantageous to arrange the other axial bore holes in the pressurized medium adapter within the circular annular groove therein, so that another reduction of the friction surface between the pressurized medium adapter and the device is prevented. Instead of a purely positive-fit connection with two alignment pins or alignment sleeves, it is also possible to realize a force-fit/positive-fit connection between the pressurized medium adapter and the device by forming one of the two other axial bore holes in the driven unit of the device as a threaded bore hole and positioning the pressurized medium adapter via an alignment pin or an alignment sleeve, as well as by fixing a threaded screw on the driven side of the device.

As an alternative embodiment to the position-exact fixing of the pressurized medium adapter on the driven unit, it is also proposed that the pressurized medium adapter has on its device-side end an annular connecting piece with an elongated inner diameter in the axial direction, with which the pressurized medium adapter can be fixed in an exactly positioned manner to the driven unit through an interference fit in a complementary receiver in the driven unit. With this embodiment, a pure force-fit connection is created between the device and the pressurized medium adapter, which also prevents relative rotation of the pressurized medium adapter to the device when it is fastened onto the camshaft and which guarantees an exact agreement of the through holes in the pressurized medium adapter with the first axial channels in the driven unit. The complementary receiver in the driven unit of the device is thus advantageously formed as a diameter extension of the centering hole receiving the centering pin of the camshaft in the driven unit, whose inner diameter corresponds to the outer diameter of the annular connecting piece on the pressurized medium adapter. For absolute security against relative rotation of the pressurized medium adapter to the device, and also for simultaneously guaranteeing the exact positioning of the pressurized medium adapter on the device, however, it is also possible here to form the connection between the pressurized medium adapter and the device simultaneously with a force fit and positive fit connection, e.g., through an additional arrangement of one or more spline-shaped shoulders on the outer diameter of the annular connecting piece on the pressurized medium adapter, which are inserted when the pressurized medium adapter is pressed into corresponding complementary recesses on the inner diameter of the diameter extension of the centering bore hole in the driven unit of the device.

Finally, one last feature of the internal-combustion engine formed according to the invention is that the second axial channels in the camshaft and the second axial channels in the driven unit of the device are formed by the fastener hole through the end and the centering pin of the camshaft and also through the driven unit in the axial direction for the central fastener for mounting the device on the camshaft. This fastener bore hole is formed in a known way on the sections in the camshaft formed without screw threads and in the driven unit with a slightly greater diameter than the shaft diameter of the central fastener, so that the hydraulic pressurized medium is led from the radial bearing of the camshaft in the axial direction through the hollow space between the outer surface of the screw shaft and the wall of the screw bore hole and also through the second radial bore holes in the driven unit of the device opening into this hollow space to the pressure chambers of the device.

The internal-combustion engine formed according to the invention with a hydraulic device for rotation angle adjustment of a camshaft relative to a crankshaft thereof thus has the advantage, relative to the internal-combustion engines known from the state of the art, that they can also be equipped through the use of a simple pressurized medium adapter adapted to the device with a device for adjusting the rotation angle, for which the number and/or the arrangement of the coaxial bore holes supplying pressurized medium to the device in the driven unit do not agree with the coaxial bore holes in the camshaft of the internal-combustion engine. Thus, the pressurized medium adapter permits advantageous multiple use of the device in different internal-combustion engines, which can eliminate costly adaptation of the driven unit of the device to internal-combustion engines with differently formed camshafts or also expensive adaptation of the different camshafts of the internal-combustion engine on the driven unit of the device, so that the production costs of such internal-combustion engines do not significantly increase due to the comparatively low production expense for the pressurized medium adapter.

BRIEF DESCRIPTION OF THE DRAWINGS

The invention is described in more detail in the following with reference to one embodiment and is shown schematically in the associated drawings. In the drawings.

DETAILED DESCRIPTION OF THE DRAWINGS

Figure 1:
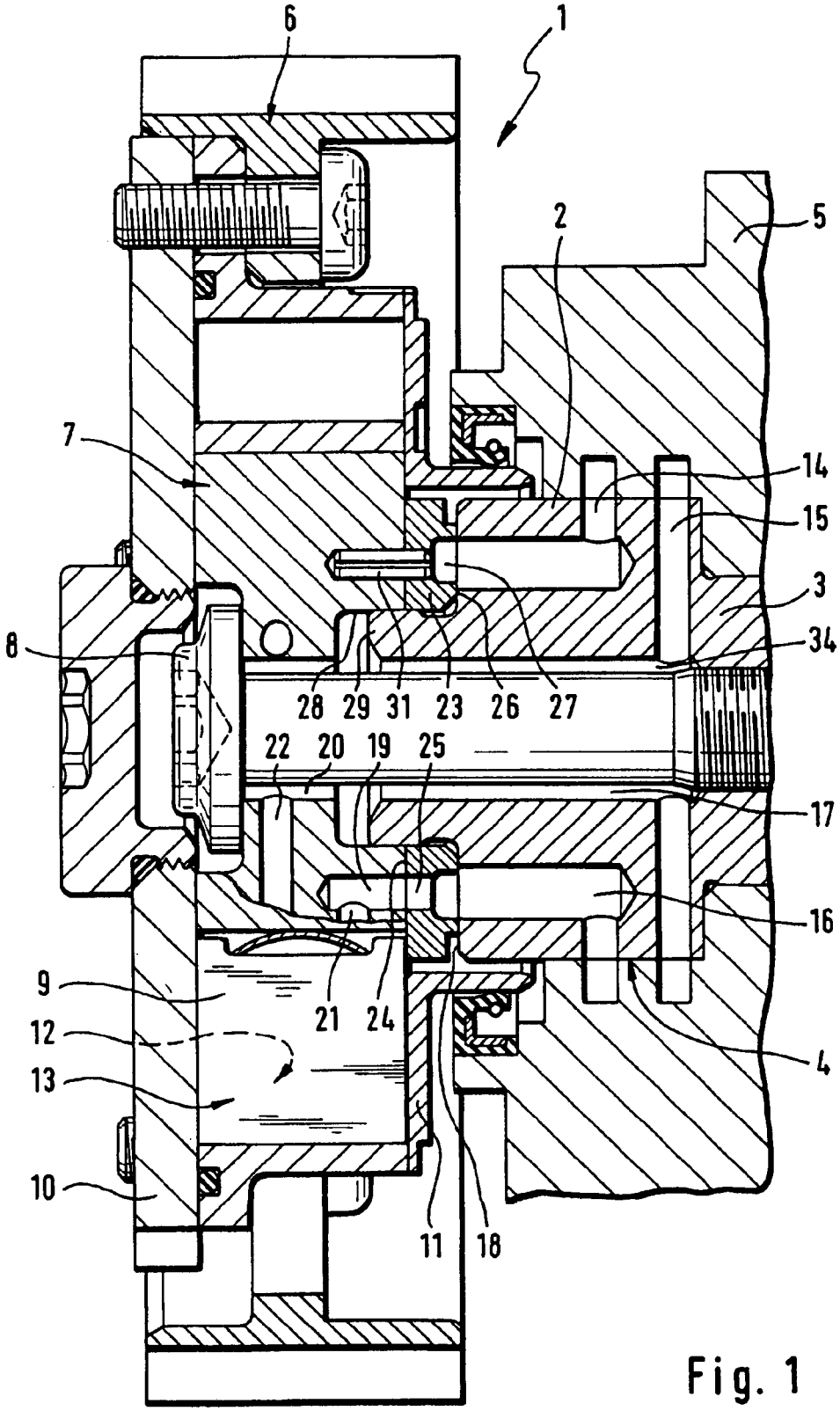
FIG. 1 is a partial view of an axial longitudinal section through the device for adjusting the rotation angle and through the cylinder head of a first embodiment of the internal-combustion engine formed according to the invention.
Figure 2:
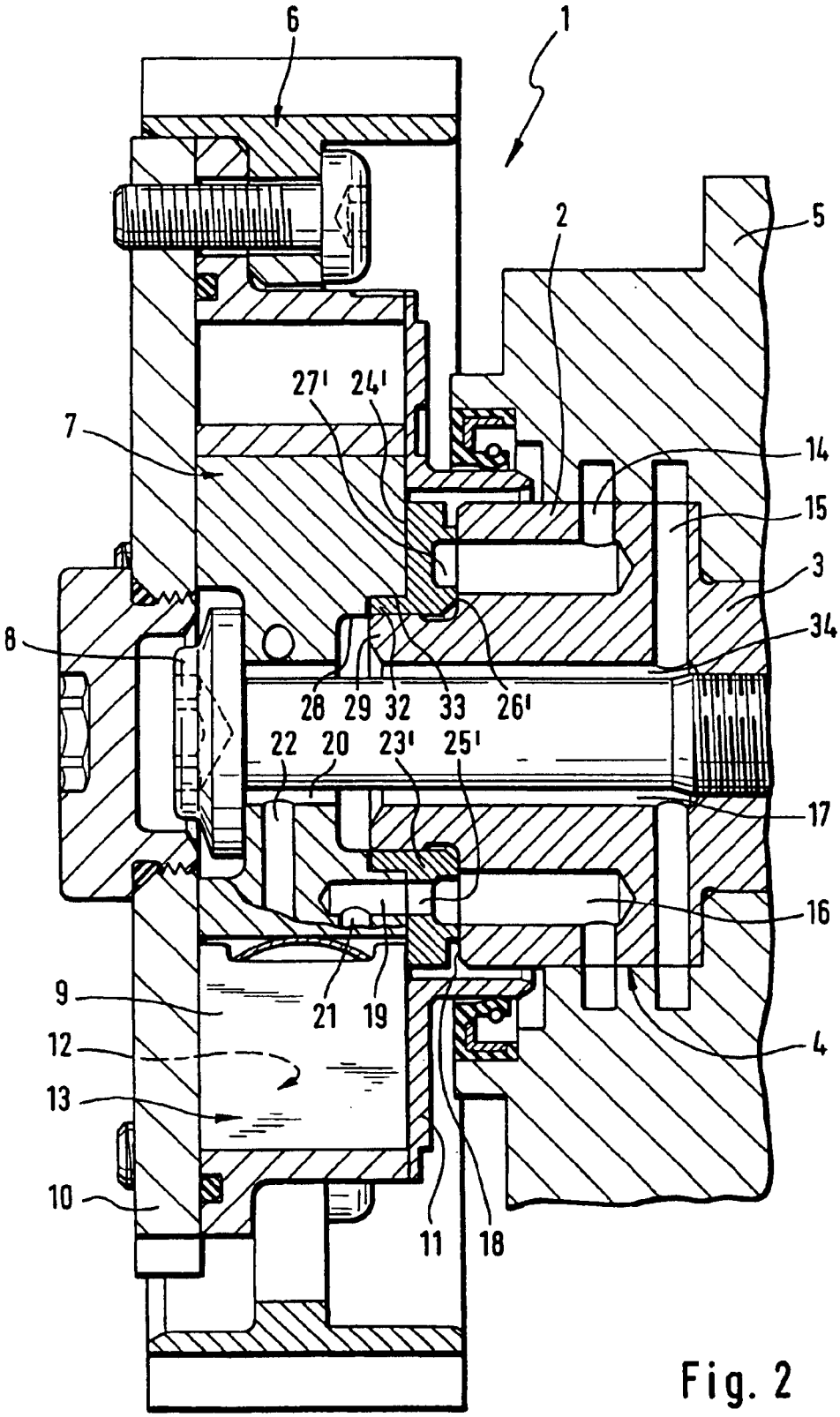
FIG. 2 is a partial view of an axial longitudinal section through the device for adjusting the rotation angle and through the cylinder head of a second embodiment of the internal-combustion engine formed according to the invention.

An internal-combustion engine with a hydraulic device 1 for rotation angle adjustment of a camshaft 3 relative to a crankshaft (not shown) follows from FIGS. 1 and 2, for which the device 1 is arranged on the drive-side end 2 of the camshaft 3 supported in several radial bearings 4 in the cylinder head 5 of the internal-combustion engine, and is formed in principle as a hydraulic actuating drive. This device 1 essentially comprises a drive unit 6 drivingly connected with the crankshaft of the internal-combustion engine and a driven unit 7, which is rotationally fixed to the camshaft 3 of the internal-combustion engine, wherein the driven unit 7 is formed as an impeller and is mounted on the camshaft 3 via an axial central fastener 8, while the drive unit 6 is formed by a hollow cylinder surrounding the driven unit 7, which is sealed tight against pressurized medium by two axial side walls 10, 11.

In addition, in FIGS. 1 and 2 it can be seen that the drive unit 6 of the device 1 is in force-transfer connection with the driven unit 7 of the device 1 through several hydraulic operating spaces, which are formed within the device 1, which are not designated in greater detail, and which are divided by the impeller blades 9 of the impeller into two pressure chambers 12, 13 that can be charged alternately or simultaneously with a hydraulic pressurized medium, wherein the hydraulic pressurized medium is removed from one of the radial bearings 4 of the camshaft 3 by the lubricating oil circuit of the internal-combustion engine. Here, the pressurized hydraulic medium is clearly guided from the radial bearing 4 first to the end 18 of the camshaft 3 via first and second radial bore holes 14, 15, and also via first and second axial channels 16, 17, which in turn are in pressurized connection via first and second axial channels 19, 20 and also via first and second radial bore holes 21, 22 in the driven unit 7 of the device 1 with the pressurized chambers 12, 13.

In addition, FIGS. 1 and 2 show that the first axial channels 16 in the camshaft 3 and the first axial channels 19 in the driven unit 7 of the device 1 are formed as axial bore holes arranged coaxially in both parts, which are connected to each other through a ring-shaped pressurized medium adapter 23, 23' arranged between the end 18 of the camshaft 3 and the driven unit 7 of the device 1. This pressurized medium adapter 23, 23' is formed on its device-side end 24, 24' with through holes 25, 25' produced in the same number and arrangement as the first axial channels 19 in the driven unit 7 and has on its camshaft-side end 26, 26' an annular groove 27, 27', which connect the through holes 25, 25' to each other and which in the shown assembled state of the pressurized medium adapter 23, 23' surround all of the first axial channels 16 for supplying pressurized medium to the device 1 emerging from the end 18 of the camshaft 3. Here, the pressurized medium adapter 23, 23' has an outer diameter corresponding to the diameter of the drive-side end 2 of the camshaft 3, while its inner diameter corresponds to the diameter of a centering pin 29 formed on the end 18 of the camshaft 3 and projecting into a centering bore hole 28 in the driven unit 7 of the device 1.

Figure 3B:
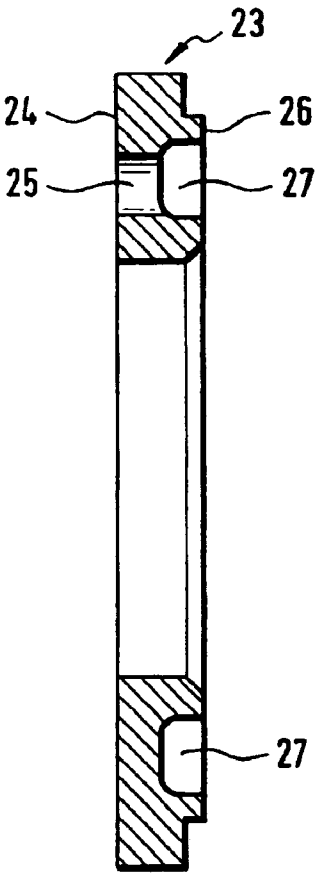
FIG. 3*b* is a cross section A—A through the pressurized medium adapter according to FIG. 3*a;*
Figure 3A:
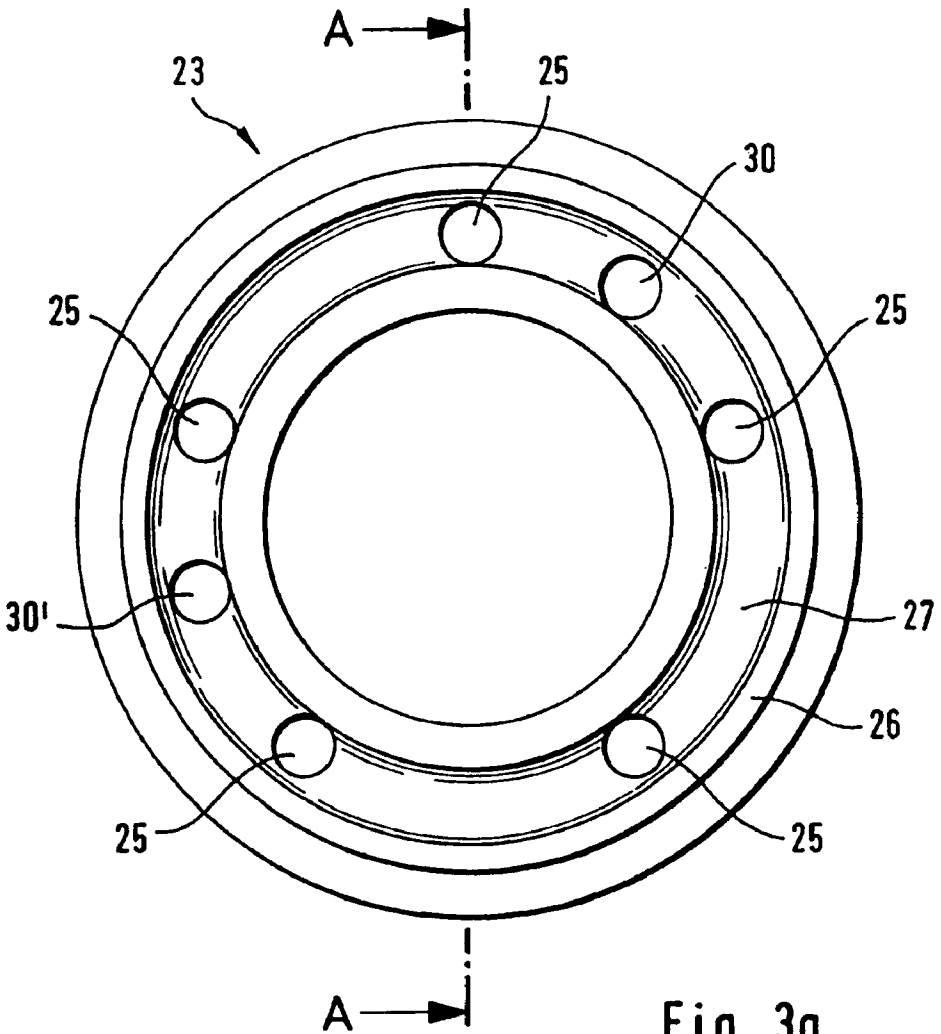
FIG. 3*a* is an enlarged detailed representation of the top view of the pressurized medium adapter of the first embodiment of the internal combustion engine formed according to the invention.

In addition, it can be seen from FIGS. 3*a* and 3*b*, as well as from 4*a* and 4*b*, that the annular groove 27, 27' of the ring wheel-shaped pressurized medium adapter 23, 23' has a rectangular cross-sectional profile, whose groove width is greater than the groove depth and also greater than a diameter of the through holes 25, 25' in the pressurized medium adapter 23, 23' and also greater than a diameter of the first axial channels 19 in the driven unit 7 of the device 1. As FIGS. 1 and 2 show, it is thus guaranteed that all of the first axial channels 16 emerging from the end 18 of the camshaft 3 open nearly independent of their number and arrangement at least with the greatest part of their diameter into the annular groove 27, 27' of the pressurized medium adapter 23, 23'.

To prevent relative rotation of the pressurized medium adapter 23 for the device 1 when the same is fastened onto the camshaft 3, for the first embodiment of the internal-combustion engine formed according to the invention shown in FIG. 1, there is also a positive-fit connection between the pressurized medium adapter 23 and the driven unit 7 of the device 1. For this purpose, both the pressurized medium adapter 23 and also the driven unit 7 of the device 1 have two other axial bore holes 30, 30', which can be clearly seen in FIG. 3*a*, in which as shown in FIG. 1, two alignment sleeves 31 are inserted, fixing the pressurized medium adapter 23 in a exact positioning manner to the driven unit 7 of the device 1. The other axial bore holes 30, 30' are here arranged in the pressurized medium adapter 23 within the circular annular groove 27 in order to prevent reduction of the friction surface between the pressurized medium adapter 23 and the device 1 through these axial bore holes 30, 30'.

Figure 4B:
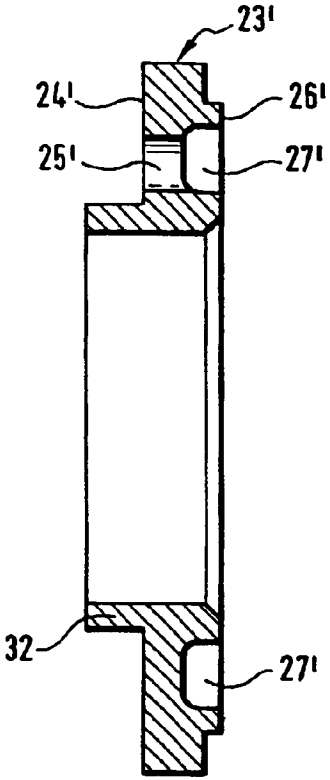
FIG. 4*b* is the cross section A—A through the pressurized medium adapter according to FIG. 4*a.*
Figure 4A:
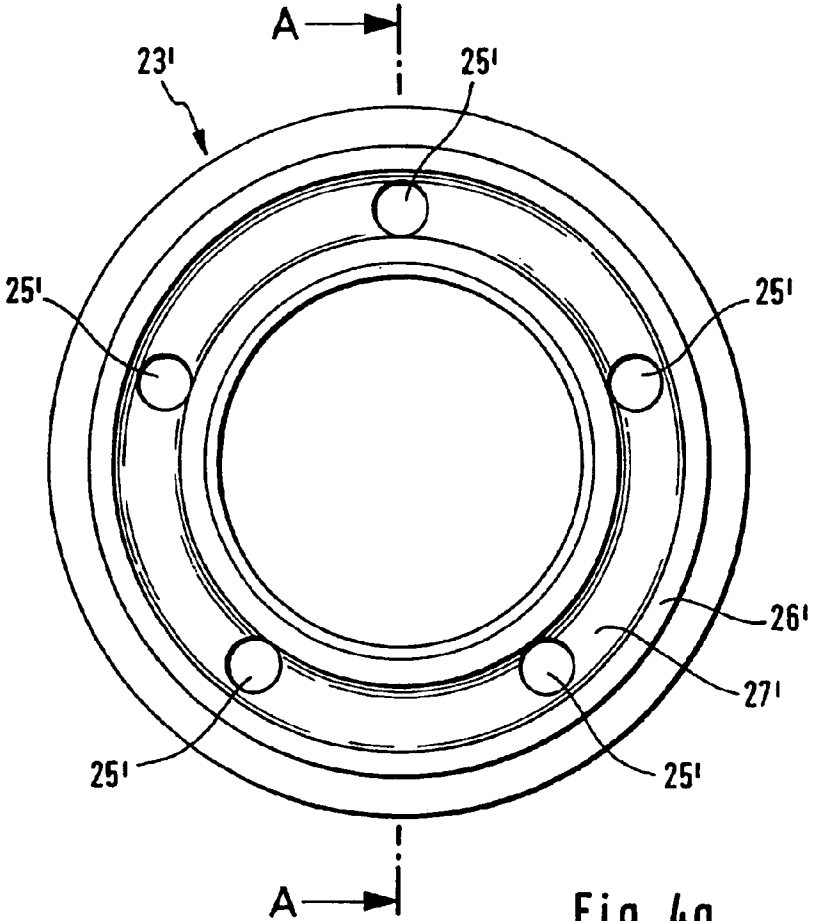
FIG. 4*a* is an enlarged detailed representation of the top view of the pressurized medium adapter of the second embodiment of the internal-combustion engine formed according to the invention.

The second embodiment of the internal-combustion engine formed according to the invention shown in FIG. 2 also prevents relative rotation of the pressurized medium adapter 23' for the device 1 when the same is fastened onto the camshaft 3, but here this is accomplished by an additional force-fit connection between the pressurized medium adapter 23' and the driven unit 7 of the device 1. Here, it can be seen from FIG. 4*a* that the pressurized medium adapter 23' for this embodiment has on its device-side end 24' an annular connecting piece 32, which extends with its inner diameter in the axial direction and with which the pressurized medium adapter 23' can be fixed in an exact positioning manner on the driven unit by an interference fit in a complementary receiver 33 in the driven unit 7 of the device 1. The complementary receiver 33 in the driven unit 7 of the device 1 is here formed by a diameter extension of the centering bore hole 28 that receives the centering pin 29 of the camshaft 3 in the driven unit 7, whose inner diameter corresponds to the outer diameter of the annular connecting piece 32 on the pressurized medium adapter 23'.

With reference to the second axial channels 17 in the camshaft 3 and the second axial channels 20 in the driven unit 7, both embodiments of the internal-combustion engine formed according to the invention in turn have in common that they are formed by central fastener bore holes 34 through the end 2 and the centering pin 28 of the camshaft 3 and also through the driven unit 7 in the axial direction for the central fastener 8 for mounting the device 1 on the camshaft 3. It can be clearly seen from FIGS. 1 and 2 that the fastener bore hole 34 on the sections formed without screw threads in the camshaft 3 and in the driven unit 7 is formed with a slightly greater diameter than the shaft diameter of the central fastener 8, so that the pressurized hydraulic medium is guided from the radial bearing 4 of the camshaft 3 in the axial direction through the hollow space between the outer surface of the screw shaft and the wall of the fastener bore hole 34 via the second radial bore holes 21, 22 opening into this hollow space in the driven unit 7 of the device 1 to the pressure chambers 12, 13 of the device 1.

LIST OF REFERENCE SYMBOLS

1 Device
2 End
3 Camshaft
4 Radial bearing
5 Cylinder head
6 Drive unit
7 Driven unit
8 Central fastener
9 Impeller blade
10 Side wall
11 Side wall
12 Pressure chamber
13 Pressure chamber
14 Radial bore holes
15 Radial bore holes
16 Axial channels
17 Axial channels
18 End
19 Axial channels
20 Axial channels
21 Radial bore holes
22 Radial bore holes
23 Pressurized medium adapter
23' Pressurized medium adapter
24 Device-side end
24' Device-side end
25 Through holes
25' Through holes
26 Camshaft-side end
26' Camshaft-side end
27 Annular groove
27' Annular groove
28 Centering bore hole
29 Centering pin
30 Axial bore holes
30' Axial bore holes
31 Alignment sleeves
32 Annular connecting piece
33 Receiver
34 fastener bore hole

What is claimed is:

1. Internal-combustion engine with a hydraulic device for rotation angle adjustment of a camshaft relative to a crankshaft, comprising:

the hydraulic device (1) for adjusting the rotation angle is arranged on a drive-side end (2) of the camshaft (3) supported by several radial bearings (4) in a cylinder head (5) of the internal-combustion engine and is formed as a hydraulic actuating drive, the hydraulic device (1) includes a drive unit (6) drivingly connected with the crankshaft of the internal-combustion engine and of a driven unit (7) rotationally fixed to the camshaft (3) of the internal-combustion engine, the driven unit (7) is mounted by an axial central fastener (8) on the camshaft (3) and the drive unit (6) is formed as a hollow cylinder, which surrounds the driven unit (7) and which is sealed from a pressurized medium by two axial side walls (10, 11), the drive unit (6) is in force-transfer connection with the driven unit (7) of the device (1) through at least two pressure chambers (12, 13), which are formed within the device (1) and which can be charged with a hydraulic pressurized medium alternately or simultaneously, the hydraulic pressurized medium is fed from one of the radial bearings (4) of the camshaft (3) and guided via first and second radial bore holes (14, 15) and also via first and second axial channels (16, 17) in the camshaft (3) first to a end (18) of the camshaft (3), the first and second axial channels (16, 17) in the camshaft (3) are in pressurized connection via first and second axial channels (19, 20) and also via first and second radial bore holes (21, 22) in the driven unit (7) of the device (1) with the pressure chambers (12, 13), wherein at least the first axial channels (16) formed as coaxial bore holes in the camshaft (3) and the first axial channels (19) in the driven unit (7) of the device (1) are connected to each other by a ring-shaped pressurized medium adapter (23, 23') arranged between the end (18) of the camshaft (3) and the driven unit (7) of the device (1), which is formed on a device-side end (24, 24') with through holes (25, 25') produced in a same number and arrangement as the first axial channels (19) in the driven unit (7) and has in a camshaft-side end (26, 26') at least one annular groove (27, 27') connecting the through holes (25, 25') to each other.

2. Device according to claim 1, wherein the ring-shaped pressurized medium adapter (23, 23') has an outer diameter corresponding to a diameter of the drive-side end (2) of the camshaft (3), and an inner diameter that corresponds to a diameter of a centering pin (29) formed on the end (18) of the camshaft (3) and projecting into a centering bore hole (28) in the driven unit (7) of the device (1).

3. Device according to claim 1, wherein the annular groove (27, 27') of the ring-shaped pressurized medium adapter (23, 23') has a rectangular cross-sectional profile with a groove width, which is greater than a groove depth and greater than a diameter of the through holes (25, 25') in the pressurized medium adapter (23, 23') as well as the first axial channels (19) which are formed as axial bore holes in the driven unit (7) of the device (1).

4. Device according to claim 1, wherein the pressurized medium adapter (23) and the driven unit (7) of the device (1) have at least two other axial bore holes (30, 30'), in which two alignment pins or alignment sleeves (31) for an exact positional fixing of the pressurized medium adapter (23) to the driven unit (7) of the device (1) can be inserted.

5. Device according to claim 2, wherein the pressurized medium adapter (23') has on the device-side end (24') an annular connecting piece (32), which has an inner diameter that extends in an axial direction and with which the pressurized medium adapter (23') can be fixed by an interference fit in a complementary receiver (33) in the driven unit (7) in an exact positioning manner.

6. Device according to claim 2, wherein the second axial channels (17) in the camshaft (3) and the second axial channels (20) in the driven unit (7) of the device (1) are formed by a fastener bore hole (34) through the end (2) and the centering pin (28) of the camshaft (3) and also through the driven unit (7) in an axial direction for the central fastener (8) for mounting the device (1) on the camshaft (3).

* * * * *